US008122950B2

(12) United States Patent
Daniel et al.

(10) Patent No.: US 8,122,950 B2
(45) Date of Patent: Feb. 28, 2012

(54) MICROWAVE-BASED DOWNHOLE ACTIVATION METHOD FOR WELLBORE CONSOLIDATION APPLICATIONS

(75) Inventors: Sylvie Daniel, Missouri City, TX (US); Mickael Allouche, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 287 days.

(21) Appl. No.: 12/420,096

(22) Filed: Apr. 8, 2009

(65) Prior Publication Data

US 2009/0260818 A1 Oct. 22, 2009

(30) Foreign Application Priority Data

Apr. 16, 2008 (EP) ..... 08154600

(51) Int. Cl.
*E21B 36/00* (2006.01)

(52) U.S. Cl. ..... 166/247; 175/64; 175/17

(58) Field of Classification Search ..... 175/64, 175/72, 17, 98; 166/247
See application file for complete search history.

(56) References Cited

U.S. PATENT DOCUMENTS 2,725,486 A * 11/1955 Walstrom ..... 250/268
(Continued)

FOREIGN PATENT DOCUMENTS

EP 0159838 10/1985
(Continued)

*Primary Examiner* — William P Neuder
*Assistant Examiner* — Catherine Loikith
(74) *Attorney, Agent, or Firm* — Myron Stout; David Cate; Robin Nava

(57) ABSTRACT

Wellbore strengthening during drilling may be achieved by including chemicals in the drilling fluid that can be polymerised when exposed to microwave energy. Selected chemicals are mixed with the drilling fluid but do not react with it. The chemicals concentrate in a filter cake on the borehole wall during drilling-fluid circulation. A tool, which comprises a microwave source, is used to trigger polymerisation or crosslinking reactions within the filter cake. The polymerisation or crosslinking reactions cause the formation of a film or gel that strengthens the wellbore.

11 Claims, 4 Drawing Sheets

U.S. PATENT DOCUMENTS

| | | | | | |
|---|---|---|---|---|---|
| 4,158,165 | A | | 6/1979 | Coates | |
| 4,547,298 | A | * | 10/1985 | Novak | 507/118 |
| 4,760,882 | A | * | 8/1988 | Novak | 166/295 |
| 4,768,593 | A | | 9/1988 | Novak | |
| 5,213,160 | A | | 5/1993 | Nahm et al. | |
| 5,464,060 | A | | 11/1995 | Hale et al. | |
| 5,476,144 | A | | 12/1995 | Nahm et al. | |
| 6,079,492 | A | * | 6/2000 | Hoogteijling et al. | 166/276 |
| 6,204,350 | B1 | | 3/2001 | Liu et al. | |
| 6,214,175 | B1 | | 4/2001 | Heinemann et al. | |
| 6,848,519 | B2 | | 2/2005 | Reddy et al. | |
| 2003/0114318 | A1 | | 6/2003 | Benton et al. | |
| 2004/0033905 | A1 | | 2/2004 | Shinbach et al. | |
| 2005/0080176 | A1 | | 4/2005 | Robb | |
| 2006/0047028 | A1 | | 3/2006 | Li et al. | |
| 2006/0065394 | A1 | | 3/2006 | Clark et al. | |
| 2006/0175059 | A1 | | 8/2006 | Sinclair et al. | |
| 2007/0144736 | A1 | | 6/2007 | Shinbach et al. | |

FOREIGN PATENT DOCUMENTS

| | | |
|---|---|---|
| EP | 0933498 | 5/2003 |
| EP | 1217166 | 8/2005 |
| GB | 2427630 | 1/2007 |
| WO | 01/28771 | 4/2001 |
| WO | 2007/044714 | 4/2007 |
| WO | 2008/008559 | 1/2008 |

* cited by examiner

MICROWAVE-BASED DOWNHOLE ACTIVATION METHOD FOR WELLBORE CONSOLIDATION APPLICATIONS

RELATED APPLICATION DATA

This application claims the benefit of EP Patent Application 08154600.4 filed Apr. 16, 2008, entitled, "Microwave-Based Downhole Activation Method For Wellbore Consolidation Applications."

TECHNICAL FIELD

This invention relates to methods and apparatus that can be used to strengthen a wellbore during a drilling operation. In particular, the invention relates to a system for activating chemical constituents of a drilling fluid deposited in a filtercake to reinforce its structure.

BACKGROUND ART

During the drilling of wells such as are used in the oil and gas industry, a drilling fluid is pumped through the well. The functions of this fluid are to carry drilled cuttings out of the borehole, to lubricate the drill bit, to balance the pressure of pore fluids in the drilled formations and to stabilise the wellbore wall, etc.

One important function is to control the well pressure and prevent downhole fluids from returning to surface. This is achieved by the hydrostatic pressure of the drilling fluid column which can be controlled by tuning the drilling fluid density. The hydrostatic pressure is selected to be higher than the pore fluid pressure (and so prevent pore fluid from entering the wellbore). However, if the hydrostatic pressure is too high, the pressure exerted on the wellbore wall might be so high as to fracture the formation. The range between pore pressure and fracturing pressure defines what is called the mud window. Once pressure reaches a value close to fracturing pressure, drilling is stopped and casing is placed and cemented to permanently isolate the formation from the wellbore. The drilling process can then start again with different conditions and a different mud window until it is necessary to set another casing. The number of casings needed for any given well will be dictated by the particular well conditions.

If the mud window can be widened by temporarily strengthening wellbore, the number of casings can be decreased and therefore the costs associated to well construction can be decreased. In addition, strengthening wellbore will reduce wellbore stability-related problems such as lost circulation or stuck pipe incidents, for example. This will translate into time savings and reduction of costs.

Finally, being able to reduce the number of casing strings by eliminating one or more of them may enable to drill deeper and reach reservoirs that could not be accessed due to the need for too many casing strings resulting in narrowing of the wellbore diameter to the extent that drilling cannot continue.

A wellbore may be strengthened during drilling by chemically modifying the mud filtercake, which is formed on the wellbore wall from mud mixed with the drilling fluid (which may contain additives) used during the drilling process.

Chemical modification of the mud filtercake will be dependant on the additives in the drilling fluid. For example, U.S. Pat. No. 4,768,593 and U.S. Pat. No. 4,760,882 disclose a drilling fluid which contains a polymeric material that, upon triggering by gamma rays or UV rays, can be crosslinked with a monomeric agent using a chemical initiator or a radioactive source, resulting in the conversion of drilling mud to cement.

U.S. Pat. No. 6,848,519 discloses the modification of the mud filtercake to form a chemical casing while drilling. The drilling fluid has a pH between 6 and 10 and contains a polymer and a water-dispersible thermoset resin that crosslinks the polymer. The drilling fluid also contains a particulate thermoset resin and a delayed dispersible acid catalyst that crosslinks the particulate thermoset resin. The chemical modification of the filtercake, which cures into a hard and tough crosslinked chemical casing, is induced by pH and temperature via curing of the thermoset resin and the use of the delayed dispersible acid catalyst.

Alternatively, instead of polymerization, cement hydration within a drilling fluid or filtercake, is also possible. U.S. Pat. No. 5,213,160, U.S. Pat. No. 5,476,144 and U.S. Pat. No. 5,464,060 disclose the addition of cement or blast furnace slag to a drilling fluid to provide a settable filtercake.

U.S. Pat. No. 6,204,350 discloses cure-on-demand, moisture-curable compositions, used as sealants, putties and adhesives, which contain an acid generating material that can be selected from carboxylate esters or sulfonate esters, as well as onium salts capable of curing the composition. The acid is released upon exposure to heat, ultraviolet light, visible light, electron beam irradiation or microwave irradiation.

Heat curable compositions used as seals, bonding materials and on tape, and that are controllably curable by microwave energy, are described in WO 01/28771.

US20060047028 discloses curing seal compositions containing a hydrogel polymer and a base material that can be polymerized in-situ by microwave irradiation, and EP0933498 discloses rapidly consolidating particulates material coated with hardenable resins in wells. U.S. Pat. No. 6,214,175 also describes recovery of gas hydrates using microwave radiation.

Microwave sources are also present in tools for measuring standoff from the borehole wall as is described in US 2006/0065394.

It is an object of this invention to provide techniques for strengthening the borehole wall during drilling and so extend the intervals between casing setting operations.

DISCLOSURE OF INVENTION

A first aspect of this invention comprises a method of constructing a borehole, comprising:

- drilling the borehole using a drilling fluid comprising a chemical system capable of being polymerised;
- allowing the drilling fluid to form a filter cake on at least part of the borehole wall in which the chemical system accumulates; and
- irradiating at least part of the filter cake with microwave radiation so as to cause the chemical system to polymerise or cross-link and so strengthen the filter cake.

The chemical system preferably comprises methacrylate based systems, dimethyldiallylammonium chloride monomer, methylenebisacrylamide, polyethylene glycol and/or polydimethylallylammonium chloride.

It is particularly preferred that a tool comprising a microwave radiation source is provided in the borehole for irradiation of the filter cake, the method comprising positioning the tool near to the part of the filter cake to be irradiated, and operating the microwave source to irradiate the filter cake. When the tool comprises at least one microwave antenna, the method typically comprises positioning the antenna near to the filter cake and using the antenna to irradiate the filter cake. The microwave source can be operated to vary the level of microwave radiation used to irradiate the filter cake.

The level of the chemical system in the drilling fluid can be adjusted so as to obtain a concentration in the filter cake that can be cross-linked or polymerised by microwave radiation.

A second aspect of the invention comprises apparatus for use in construction of a borehole, comprising:

a tool body;

a source of microwave radiation located in the tool body; and means for irradiating the borehole wall with microwave radiation from the source;

wherein the means for irradiating the borehole wall comprises an antenna that can be positioned near to the borehole wall, and the source is operable to initiate polymerisation or cross-linking in a chemical system in a filter cake on the borehole wall.

The tool preferably comprises at least one arm mounted on the tool body, the microwave antenna being mounted at the end of the arm. The arm can be extendible, and a preferred embodiment comprises multiple arms spaced axially and or azimuthally on the tool body. Each arm can carry an antenna that is connected to the microwave source.

In the present invention, selected chemicals are mixed with drilling fluid and accumulate in the mud filtercake. A tool, which delivers microwaves downhole, is then used to trigger a downhole reaction within the filtercake. The microwaves heat the mud filtercake and initiate polymerisation of the selected chemicals within the filtercake, leading to the creation of a film or gel appropriate for wellbore strengthening.

Further aspects of the invention will be apparent from the following description.

BRIEF DESCRIPTION OF FIGURES IN THE DRAWINGS

MODE(S) FOR CARRYING OUT THE INVENTION

Figure 1:
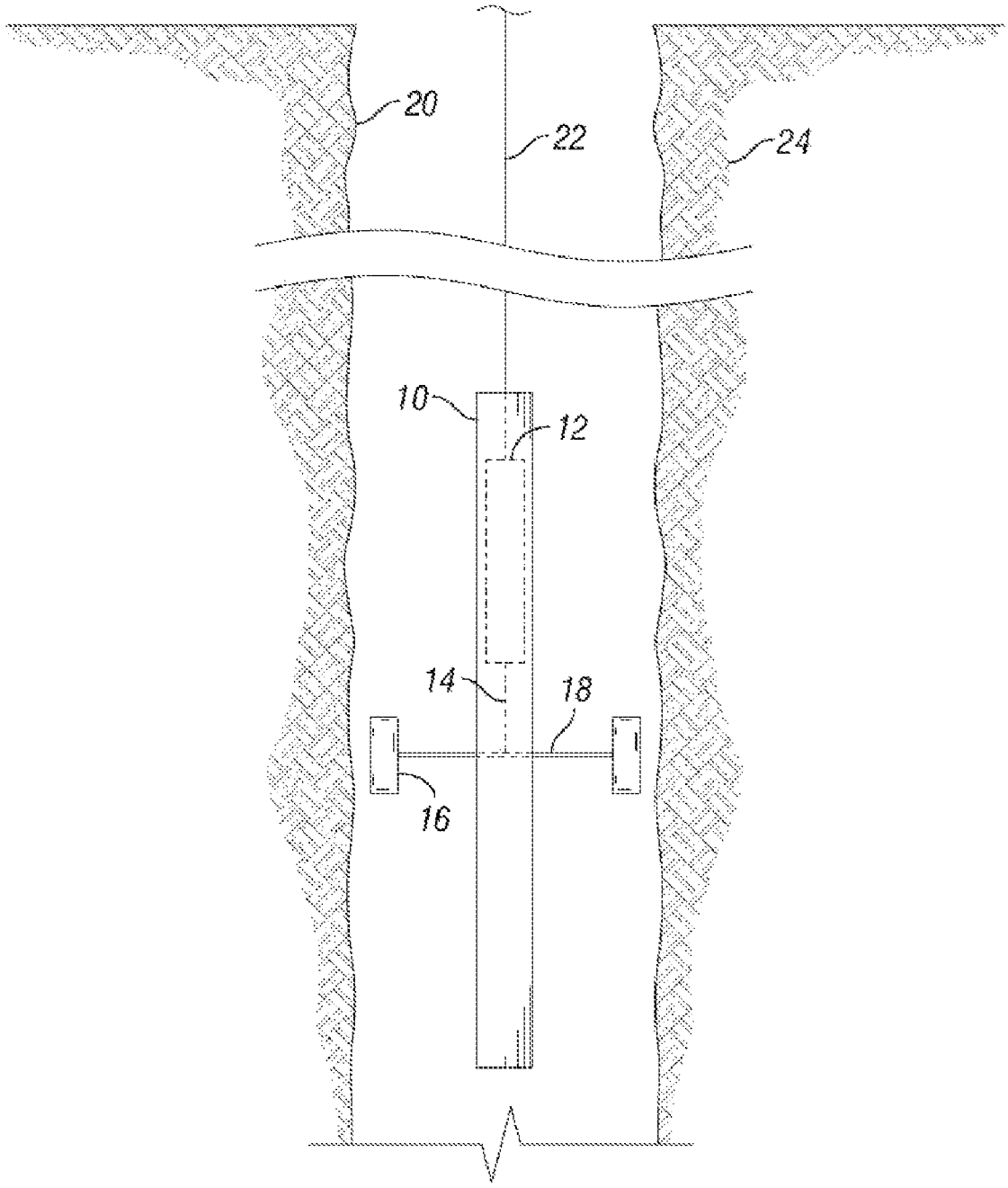
FIG. 1 shows a schematic diagram of an embodiment of the invention.
Figure 2:
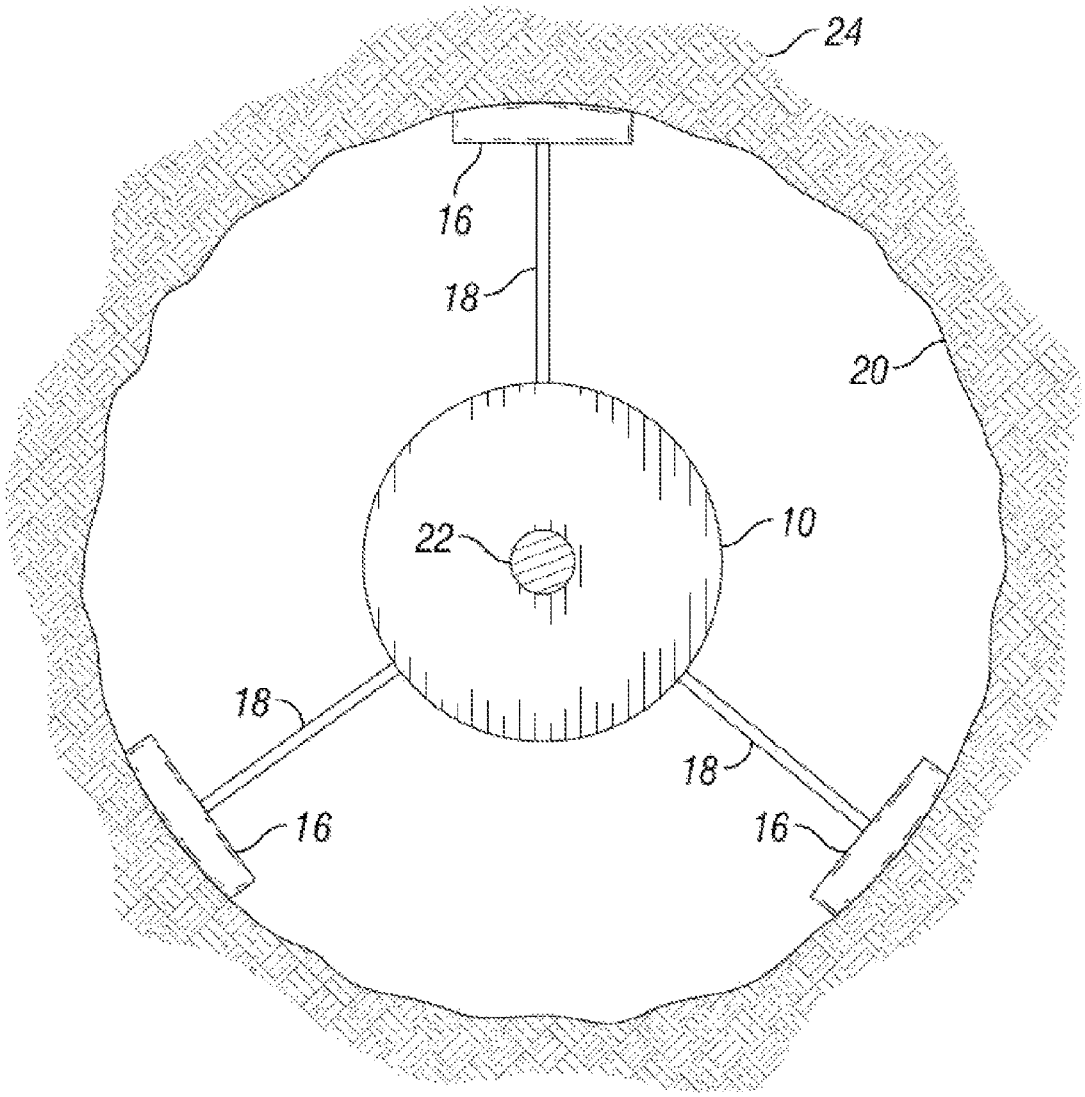
FIG. 2 shows the schematic top view of the tool of FIG. 1.

In accordance with this invention, chemicals are mixed into the drilling fluid during the process of drilling a well. These chemicals do not react with the drilling fluid while it is being pumped through the borehole, but accumulate within the mud filtercake and polymerize or undergo a crosslinking reaction initiated by microwave radiation. FIGS. 1 and 2 show a first embodiment of the invention, in which microwave radiation is provided by a tool 10 which comprises a microwave source 12 that can be switched on or off, and which is connected, by means of a cable 14, to one or more transmitting antennae 16 mounted at the end of arms 18 which can be used to position the antennae close to the borehole wall 20. The tool is placed downhole by means of a wireline cable 22 (other conveyance means such as drill pipe or coiled tubing can also be used), and is activated downhole when near a region of interest 24. The tool may also be placed in a drill string above the bit so that it will deliver microwaves during drilling and irradiate the newly-formed filtercake.

The tool has three articulated extendable arms 18. Ideally, the three arms 18 are extended at all times and touch the formation with an equal load on each of them to ensure full and efficient coverage of the borehole wall 20.

The cable 14 is preferably sufficiently robust to allow for the adjustment of the power of the microwaves emitted by the antennae 16 to achieve an adequate level of polymerization or crosslinking downhole.

The advantage of using microwave irradiation is that it can produce a high rate of heating. Once the microwave source is switched on, high temperatures can be reached within seconds and the reaction can start almost instantaneously. Therefore chemical modification via polymerisation or crosslinking can be achieved in much shorter periods of time when compared to using conventional heating methods. The risk of degradation due to the high temperatures generated by the microwave irradiation is minimised by enabling the microwave source within the tool to be switched on or switched off.

The concentration of the chemicals in the drilling fluid is selected so that the final concentration in the filtercake is adequate to form a film or a gel or to produce connectivity in-between the molecules when irradiated with microwaves.

Candidate chemical systems comprise chemical systems that can be polymerized, and include methacrylate based systems, dimethyldiallylammonium chloride monomer. Crosslinkers such as methylenebisacrylamide can also result in a strong network within the filtercake. Also, crosslinking of oligomers or macromers can also be of interest. Systems that include oligomers or macromers include, for example, poly (ethylene glycol) or poly(dimethylallylammonium chloride). The particular chemical system chosen will depend on the particular drilling fluid system being used, the degree of support required once polymerised, etc.

Figure 3:
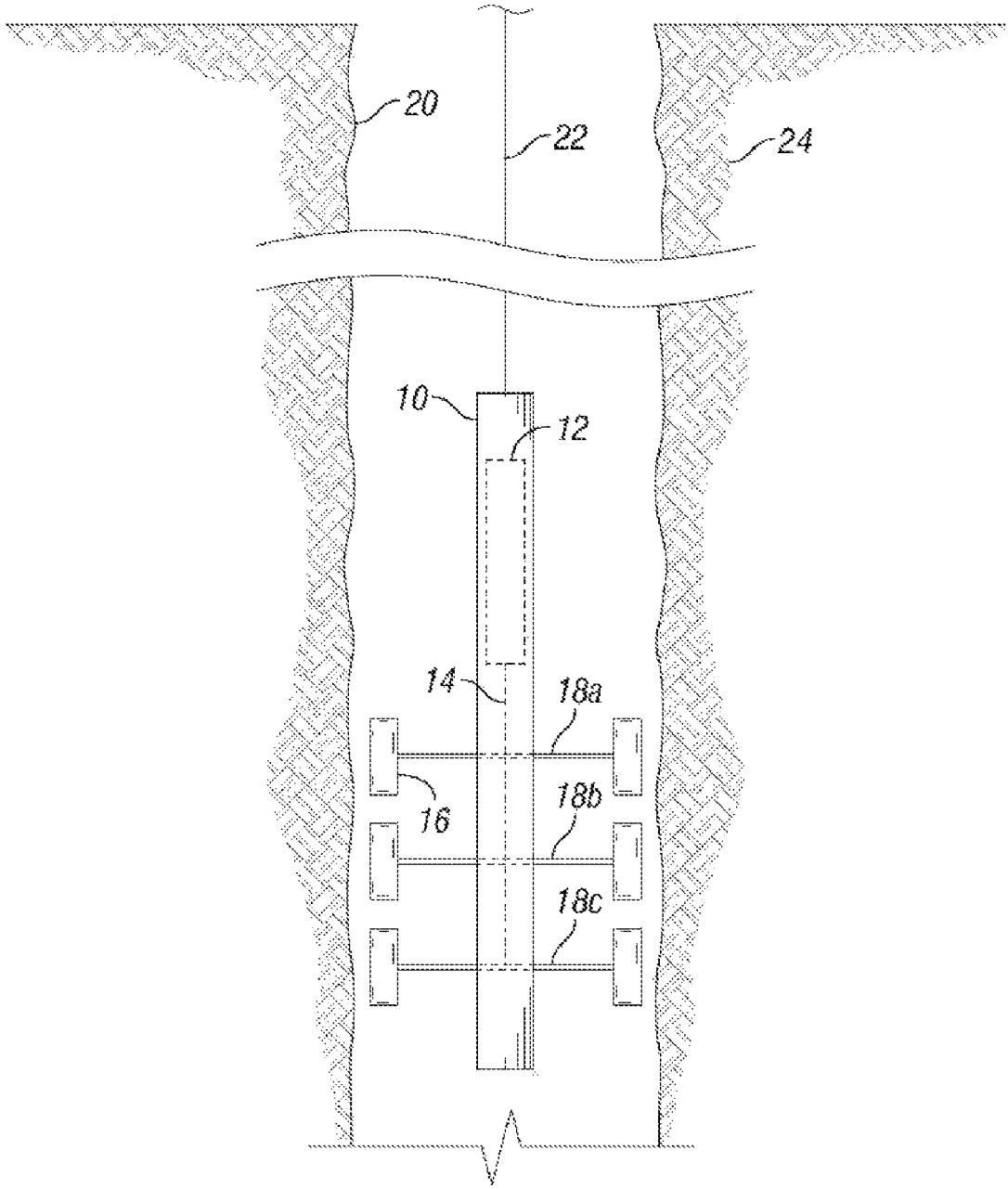
FIG. 3 shows a schematic diagram of a second embodiment of the invention.

Various changes can be made within the scope of the invention. FIG. 3 shows a second embodiment of the invention, in which three sets of arms 18*a*, 18*b*, 18*c* are arranged along the tool body 10. This allows a greater area of the borehole wall 20 to be covered and stabilised for a given position of the tool. As well as being arranged along the tool body, the arms of each set can be offset from the others so as to provide improved azimuthal coverage of the borehole wall.

Figure 4:
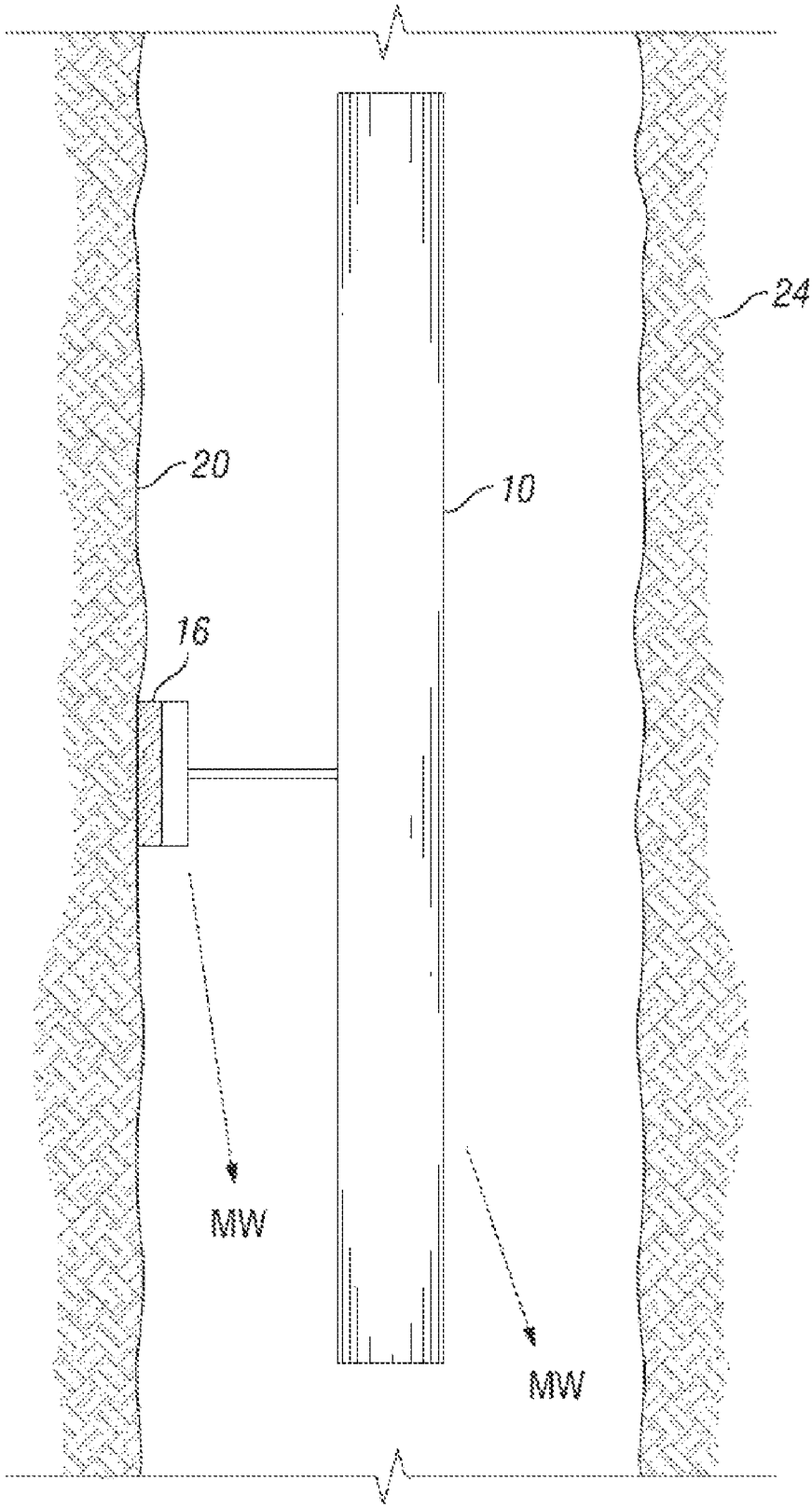
FIG. 4 shows further detail of the tool of FIG. 1 or 3.

While the antennae 16 are designed to focus microwave radiation onto the borehole wall 20 so as to cause polymerisation, there is still a likelihood that microwave leakage MW from the antenna 16 or tool 10 will start polymerisation in the circulating drilling fluid leading to thickening (see FIG. 4). In order to prevent thickened drilling fluid being re-circulated and going back to the surface, a series of diverting blades or mechanical devices may preferably be positioned above each pad. The diverting blades can break the gelled circulating fluid that results from the irradiation of the filtercake and/or the drilling fluid.

Other changes within the scope of the invention will be apparent.

The invention claimed is:

1. A method of constructing a borehole, the method comprising:

drilling the borehole using a drilling fluid comprising a chemical system capable of being polymerised;

allowing the drilling fluid to circulate and form a filter cake on at least part of the borehole wall in which the chemical system accumulates; and during circulation, irradiating at least part of the filter cake with microwave radiation so as to cause the chemical system to polymerise or cross-link and so strengthen the filter cake.

2. The method as claimed in claim 1, wherein the chemical system comprises methacrylate based systems, dimethyldiallylammonium chloride monomer, methylenebis acrylamide, polyethylene glycol and/or polydimethylallylammonium chloride.

3. The method as claimed in claim 1, wherein a tool comprising a microwave radiation source is provided in the borehole for irradiation of the filter cake, the method comprising positioning the tool near to the part of the filter cake to be irradiated, and operating the microwave source to irradiate the filter cake.

4. The method as claimed in claim 3, wherein the tool comprises at least one microwave antenna, the method comprising positioning the antenna near to the filter cake and using the antenna to irradiate the filter cake.

5. The method as claimed in claim 3, comprising operating the microwave source to vary the level of microwave radiation used to irradiate the filter cake.

6. The method as claimed in claim 1, comprising adjusting the level of the chemical system in the drilling fluid so as to obtain a concentration in the filter cake that can be cross-linked or polymerised by microwave radiation.

7. An apparatus for use in construction of an open borehole, comprising:

a tool body;

a source of microwave radiation located in the tool body; and means for irradiating borehole wall with microwave radiation from the source;

wherein the means for irradiating the borehole wall comprises an antenna that can be positioned near to the borehole wall, and the source is operable to initiate polymerisation or cross-linking in a chemical system in a filter cake on the borehole wall.

8. The apparatus as claimed in claim 7, further comprising at least one arm mounted on the tool body, the microwave antenna being mounted at the end of the arm.

9. The apparatus as claimed in claim 8, wherein the arm is extendable.

10. The apparatus as claimed in claim 8, comprising multiple arms spaced axially, azimuthally, or both, on the tool body.

11. The apparatus as claimed in claim 10, wherein each arm carries an antenna that is connected to the microwave source.

* * * * *